US012778198B2

(12) United States Patent
Wang

(10) Patent No.: US 12,778,198 B2
(45) Date of Patent: Nov. 3, 2026

(54) ELECTRONIC CIGARETTE ATOMIZATION CORE

(71) Applicant: Aspire North America LLC, Venice, CA (US)

(72) Inventor: Michael Wang, Redondo Beach, CA (US)

(73) Assignee: Asoure Birth America LLC, Venice, CA (US)

( * ) Notice: Subject to any disclaimer, the term of this patent is extended or adjusted under 35 U.S.C. 154(b) by 553 days.

(21) Appl. No.: 18/200,466

(22) Filed: May 22, 2023

(65) Prior Publication Data

US 2024/0389656 A1 Nov. 28, 2024

(51) Int. Cl.

| | |
|---|---|
| ***A24F 40/46*** | (2020.01) |
| ***A24F 40/10*** | (2020.01) |
| ***A24F 40/20*** | (2020.01) |
| ***A24F 40/40*** | (2020.01) |
| ***A24F 40/42*** | (2020.01) |

(52) U.S. Cl.

CPC ..... *A24F 40/46* (2020.01); *A24F 40/10* (2020.01); *A24F 40/20* (2020.01); *A24F 40/40* (2020.01); *A24F 40/42* (2020.01)

(58) Field of Classification Search

None

See application file for complete search history.

(56) References Cited

U.S. PATENT DOCUMENTS

2022/0338538 A1* 10/2022 Schlaegel ..... A24F 40/90

FOREIGN PATENT DOCUMENTS

| | | | |
|---|---|---|---|
| CN | 215531637 | U | 1/2022 |
| CN | 217937241 | U | 12/2022 |
| WO | 2021203839 | A1 | 10/2021 |

OTHER PUBLICATIONS

English machine translation of CN115316707 to Li et al.; published Nov. 11, 2022; 16 pages. (Year: 2022).*

English machine translation of CN 115039921 to Wang; published Sep. 13, 2022; 11 pages. (Year: 2022).*

* cited by examiner

*Primary Examiner* — Linda L Gray

(74) *Attorney, Agent, or Firm* — Harter Secrest & Emery LLP

(57) ABSTRACT

An atomization core provides a core body having a central channel, a generally cylindrical, ceramic first layer having an outer diameter and an inner diameter, and a generally cylindrical, ceramic second layer having an outer diameter and an inner diameter. The central channel extends through the first and second layers. The first layer, the second layer, and the central channel are aligned about a central axis, and the inner diameter of the second layer is about equal to the outer diameter of the first layer.

20 Claims, 7 Drawing Sheets

ELECTRONIC CIGARETTE ATOMIZATION CORE

TECHNICAL FIELD

The present disclosure generally relates to atomization and vaporizing devices, and more particularly, to an atomization core of an electronic cigarette device.

BACKGROUND

Electronic cigarette (also known as "E-cigarette"), or vaping, devices can be used to deliver nicotine, *cannabis* (THC, CBD), flavorings, chemicals, and other substances. These devices are known by many different names and come in many shapes, sizes and device types. These devices may also be referred to as "E-cigs", "Vapes", "Vape pens," "dab pens," "dab rigs," "Tanks," "Mods," "Pod-Mods," and the like. Use of e-cigarette, or vaping, products is sometimes referred to as "vaping."

Typically, a conventional e-cigarette device or electronic cigarette device includes several basic components: a cartridge (also referred to as a reservoir or pod), an atomizer (or atomizer core) including a heating element, a power source (e.g., a battery), and a mouthpiece. The cartridge (or reservoir or pod) can hold various substances. The cartridge may be pre-loaded with these substances, and sold with or separate from the rest of the e-cigarette device. One particular substance is a liquid solution (sometimes referred to as "e-liquid" or "e-juice"). In one particular example, the liquid solution may contain varying amounts of nicotine, *cannabis* (THC, CBD), flavorings, and/or other chemicals. Some conventional e-cigarette devices may not use a cartridge to hold the liquid solution. Instead, these e-cigarette devices include a reservoir built-into the device for containing the liquid solution, and into which the liquid solution can be filled. In many e-cigarette devices, puffing by a user results in an airflow entering the electronic cigarette device. As the air flows into the electronic cigarette device, the generated airflow will trigger an airflow sensor, and thereby activate the heating element of the atomizer. The electric heating element, disposed within an atomization channel of the atomizer core, starts to heat the e-liquid, and generate aerosol or vapor, which then flows out through the atomization channel under the drive of the airflow, and the resulting aerosol or vapor travels to the mouthpiece where the aerosol or vapor is then inhaled by the user.

In a conventional electronic cigarette device, a ceramic atomization core have a single-layer structure. In terms of ceramic, "porosity" refers to the proportion of the volume of the pores in the ceramic to the overall volume of the ceramic, and the porosity of the ceramic is generally between 20% and 65%. If the ceramic material of the core has a high porosity, an e-liquid guide speed (i.e., the speed that e-liquid disseminates through the ceramic material) can be too high, and result in the problem of e-liquid leakage (i.e., e-liquid passing from the interior atomization core due to too much e-liquid present in the core to be vaporized by the heating element efficiently). Also, if the ceramic material of the core has a low porosity, e-liquid supply would be not delivered in a timely manner to the heating element, and result in "dry burning" within the core. Accordingly, there is a need for an improved atomization core of an electronic cigarette device. There is a further need for an improved atomization core of an electronic cigarette that provides at least two (2) layers in the atomization core. There is an additional need for an improved atomization core of an electronic cigarette device made of at least two (2) layers of ceramic material. There is also a need for an improved atomization core of an electronic cigarette device made of at least two (2) layers of ceramic material, where each layer has a different porosity from at least one other layer. There is a need for an improved atomization core of an electronic cigarette device having multiple layers of ceramic material, where the layers have different porosities in a combined manner, so that the atomization core has the advantages of both high porosity and low porosity while avoiding the disadvantages of each of high porosity and low porosity. There is a further need for an improved atomizer core of an electronic cigarette device that is easier to manufacture, assemble, disassemble, adjust, and maintain. The present invention satisfies these needs and provides other related advantages.

SUMMARY OF THE INVENTION

The present invention provides an improved atomizer core of an electronic cigarette device. The present invention provides an improved atomizer core of an electronic cigarette that provides at least two (2) layers in the atomization core. The present invention provides an improved atomizer core of an electronic cigarette device made of at least two (2) layers of ceramic material. The present invention provides an improved atomizer core of an electronic cigarette device made of at least two (2) layers of ceramic material, where each layer has a different porosity from at least one other layer. The present invention provides an improved atomizer core of an electronic cigarette device having multiple layers of ceramic material, where the layers have different porosities in a combined manner, so that the atomization core has the advantages of both high porosity and low porosity while avoiding the disadvantages of each of high porosity and low porosity. The present invention provides an improved atomizer core of an electronic cigarette device that is easier to manufacture, assemble, adjust, and maintain. The present invention satisfies these needs and provides other related advantages.

In accordance with an embodiment of the present invention, an atomization core includes a core body having a central channel, a generally cylindrical, ceramic first layer having an outer diameter and an inner diameter, and a generally cylindrical, ceramic second layer having an outer diameter and an inner diameter. The central channel extends through the first and second layers, and the first layer, the second layer, and the central channel are aligned about a central axis. The inner diameter of the second layer is about equal to the outer diameter of the first layer.

In accordance with another embodiment of the present invention, the atomization core further includes a heating element embedded in the core body and spirally arranged about the central channel.

In accordance with an additional embodiment of the present invention, the core body includes a microporous ceramic.

In accordance with a further embodiment of the present invention, the core body includes a generally cylindrical core body.

In accordance with a still further embodiment of the present invention, the central channel includes two separate channels.

In accordance with still another embodiment of the present invention, the porosity of the ceramic first layer is greater than the porosity of the ceramic second layer.

In accordance with yet another embodiment of the present invention, the porosity of the ceramic first layer is lesser than the porosity of the ceramic second layer.

In accordance with yet a further embodiment of the present invention, the atomization core further includes a third layer having an outer diameter and an inner diameter where the first layer, the second layer, the third layer, and the central channel are aligned about the central axis. The inner diameter of the third layer is about equal to the outer diameter of the second layer.

In accordance with an embodiment of the present invention, an atomization core includes a core body having a central channel, a generally cylindrical, ceramic first layer having an outer diameter and an inner diameter, and a generally cylindrical, ceramic second layer having an outer diameter and an inner diameter. The central channel extends through the first and second layers, and the first layer, the second layer, and the central channel are aligned about a central axis. The porosity of one of the ceramic layers is greater than the porosity of the other ceramic layer, and the inner diameter of the second layer is about equal to the outer diameter of the first layer.

In accordance with another embodiment of the present invention, the atomization core further includes a heating element embedded in the core body and spirally arranged about the central channel.

In accordance with an additional embodiment of the present invention, the core body includes a microporous ceramic.

In accordance with a further embodiment of the present invention, the core body includes a generally cylindrical core body.

In accordance with yet another embodiment of the present invention, the central channel includes two separate channels.

In accordance with yet a further embodiment of the present invention, the porosity of the ceramic first layer is greater than the porosity of the ceramic second layer.

In accordance with yet an additional embodiment of the present invention, the porosity of the ceramic first layer is lesser than the porosity of the ceramic second layer.

In accordance with still another embodiment of the present invention, the atomization core further includes a third layer having an outer diameter and an inner diameter, and where the first layer, the second layer, the third layer, and the central channel are aligned about the central axis. The porosity of at least one of the ceramic layers is greater than the porosity of at least one of the other ceramic layers, and the inner diameter of the third layer is about equal to the outer diameter of the second layer.

This brief summary has been provided so that the nature of the invention may be understood quickly. Additional aspects and advantages of the present invention will be given in part in the following more detailed description, taken in conjunction with the accompanying drawings, which can become apparent from the following description, which illustrate, by way of example, the principles of the invention or be understood through practice of the present invention. Any drawings contained herein constitute a part of this specification and include exemplary embodiments of the present invention and illustrate various objects and features thereof.

DESCRIPTION OF THE FIGURES

The various present embodiments now will be discussed in detail with an emphasis on highlighting the advantageous features with reference to the drawings of various embodiments. The illustrated embodiments are intended to illustrate, but not to limit the invention. These drawings include the following figures, in which like numerals indicate like parts: The above and/or additional aspects and advantages of the present invention will be apparent and easily understood from the descriptions of the embodiments with reference to the following drawings, wherein.

DETAILED DESCRIPTION

Figure 1:
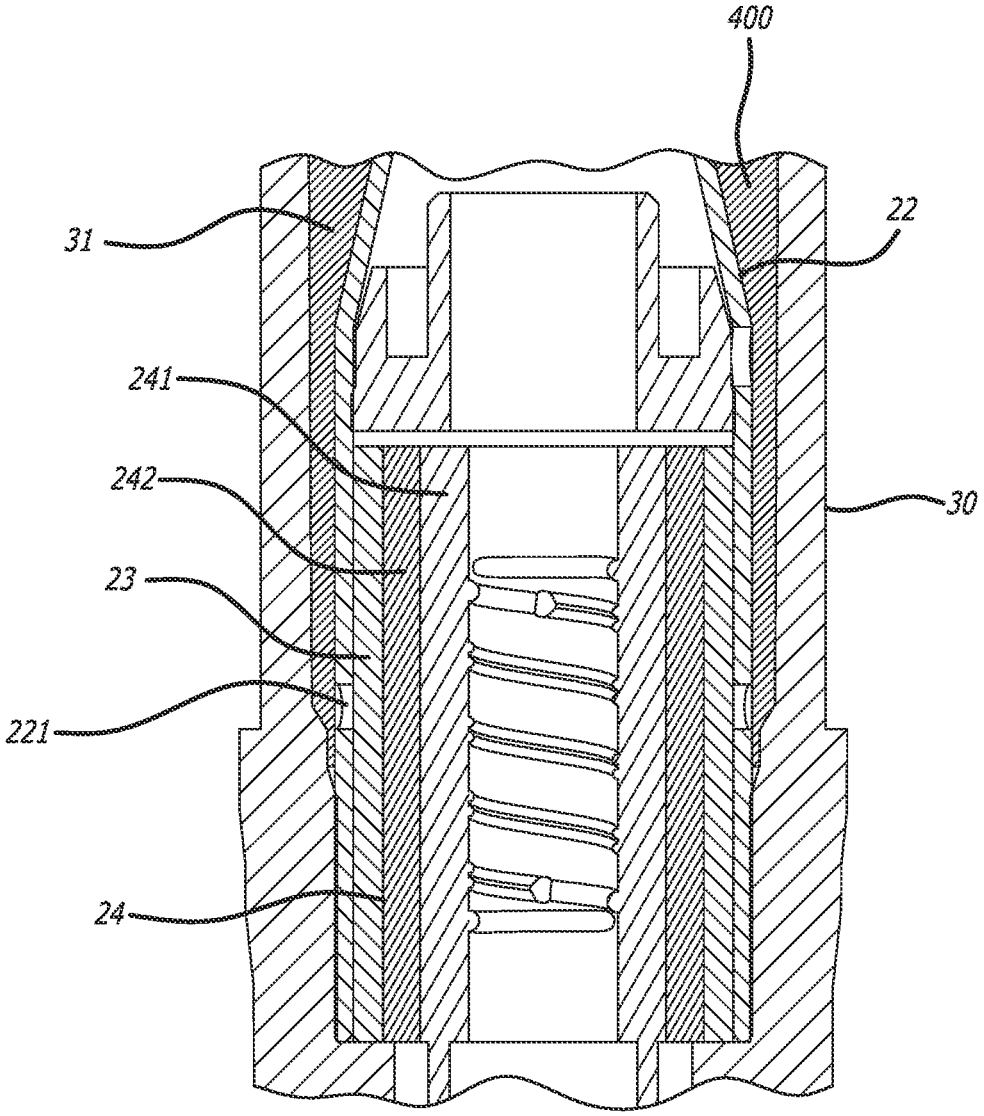
FIG. 1 illustrates a cross-sectional view of an atomizer core of an electronic cigarette assembly according to an embodiment of the present invention.
Figure 2:
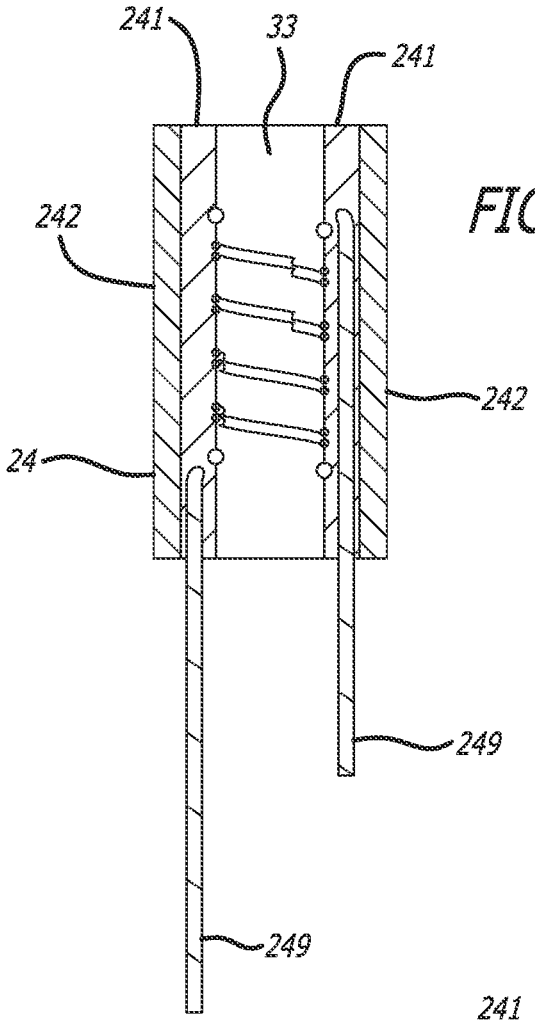
FIG. 2 illustrates the atomizer core of FIG. 1.
Figure 3:
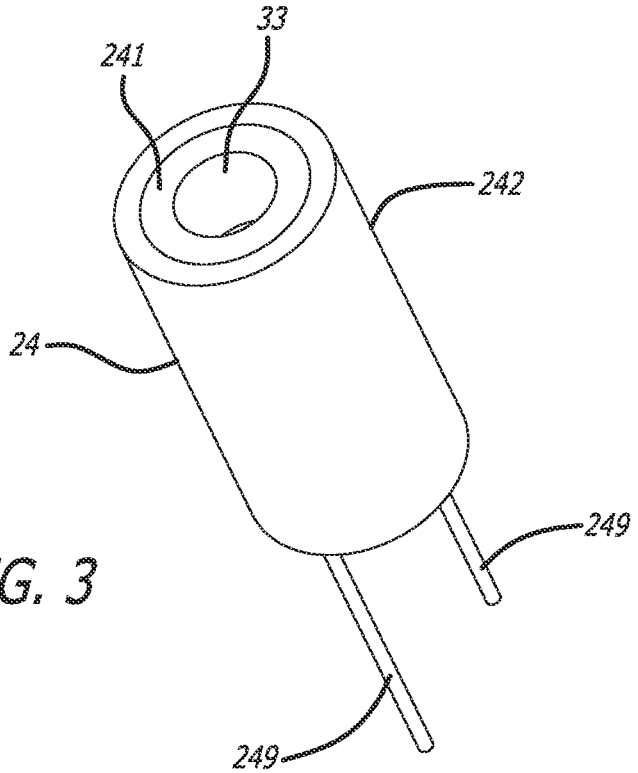
FIG. 3 illustrates a perspective view of the atomizer core of FIG. 2.
Figure 4A:
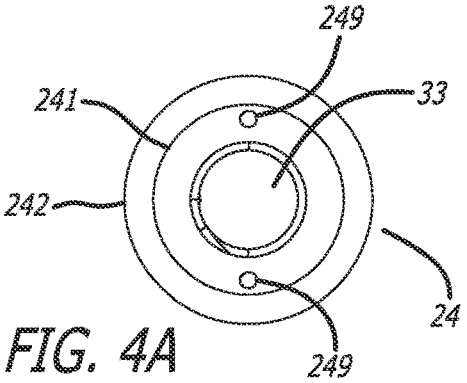
FIG. 4A illustrates a bottom view of the atomizer core of FIG. 3
Figure 4B:
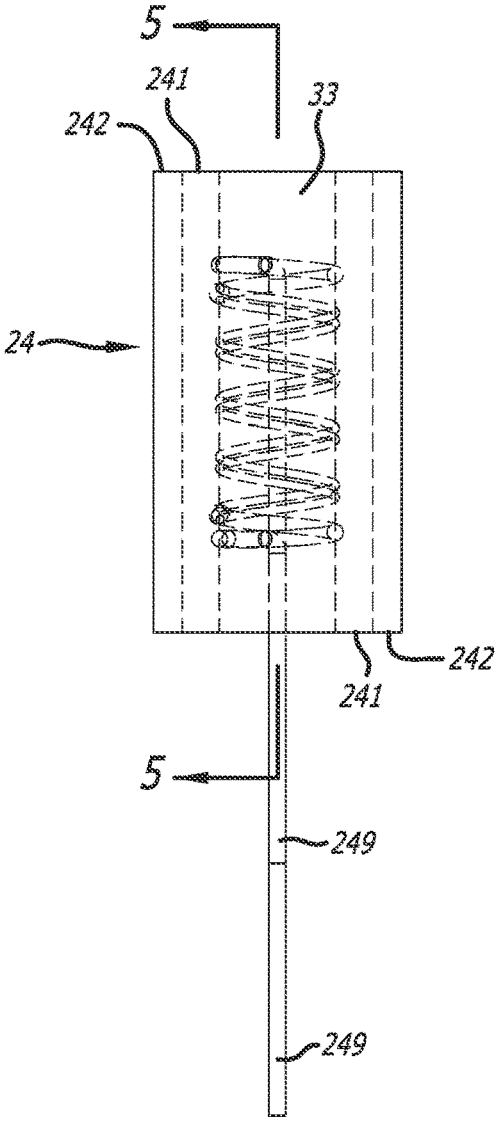
FIG. 4B illustrates a side elevation view of the atomizer core of FIG. 3.
Figure 5:
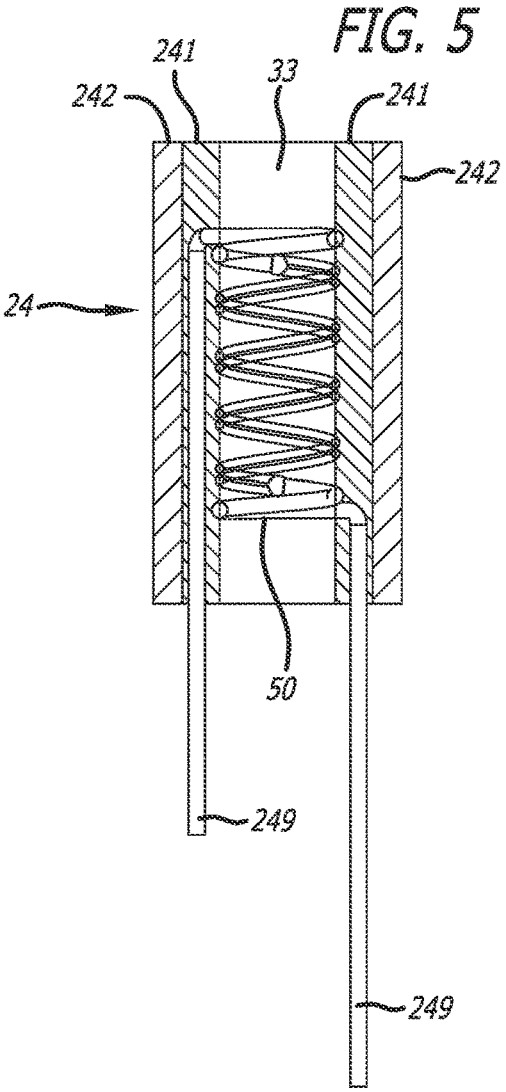
FIG. 5 illustrates a cross-sectional view of the atomizer core of FIG. 3, taken along line 5-5 of FIG. 4B.
Figure 6:
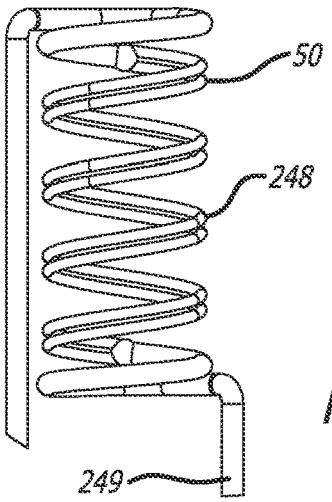
FIG. 6 illustrates a side elevation view of a heating element of the atomizer core of FIG. 3.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an electronic cigarette assembly. The following detailed description describes the present embodiments, with reference to the accompanying drawings. In the drawings, reference numbers label elements of the present embodiments. These reference numbers are reproduced below in connection with the discussion of the corresponding drawing features. It is to be understood that the figures and descriptions of the present invention have been simplified to illustrate elements that are relevant for a clear understanding of the present invention, while eliminating, for the purpose of clarity, many other elements found in electronic cigarette assemblies. Those of ordinary skill in the pertinent arts may recognize that other elements and/or steps are desirable and/or required in implementing the present invention. However, because such elements and steps are well known in the art, and because they do not facilitate a better understanding of the present invention, a discussion of such elements and steps is not provided herein. The disclosure herein is directed to all such variations and modifications to such elements and methods known to those skilled in the pertinent arts.

Embodiments of the present invention are described in detail hereinafter, and illustrations of the embodiments are shown in the drawings, wherein identical or similar reference numerals denote identical or similar elements or elements having the same or similar functions. The embodiments described hereinafter with reference to the drawings are exemplary and only intended to explain the present invention, and cannot be understood as limiting the present invention.

Figure 9A:
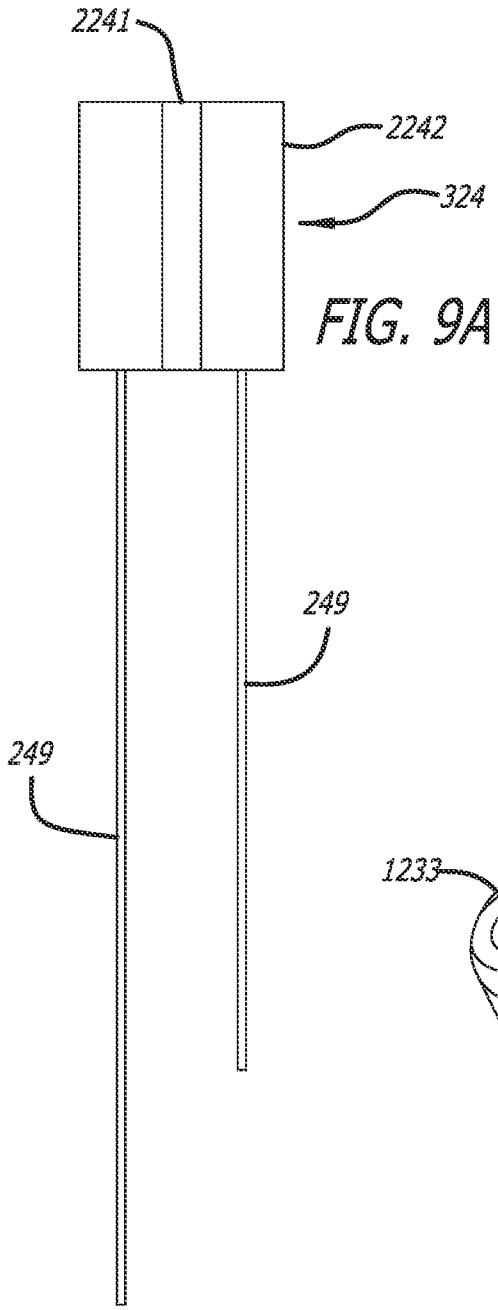
FIG. 9A illustrates a cross-sectional view of an atomizer core of an electronic cigarette assembly according to still another embodiment of the present invention.
Figure 9B:
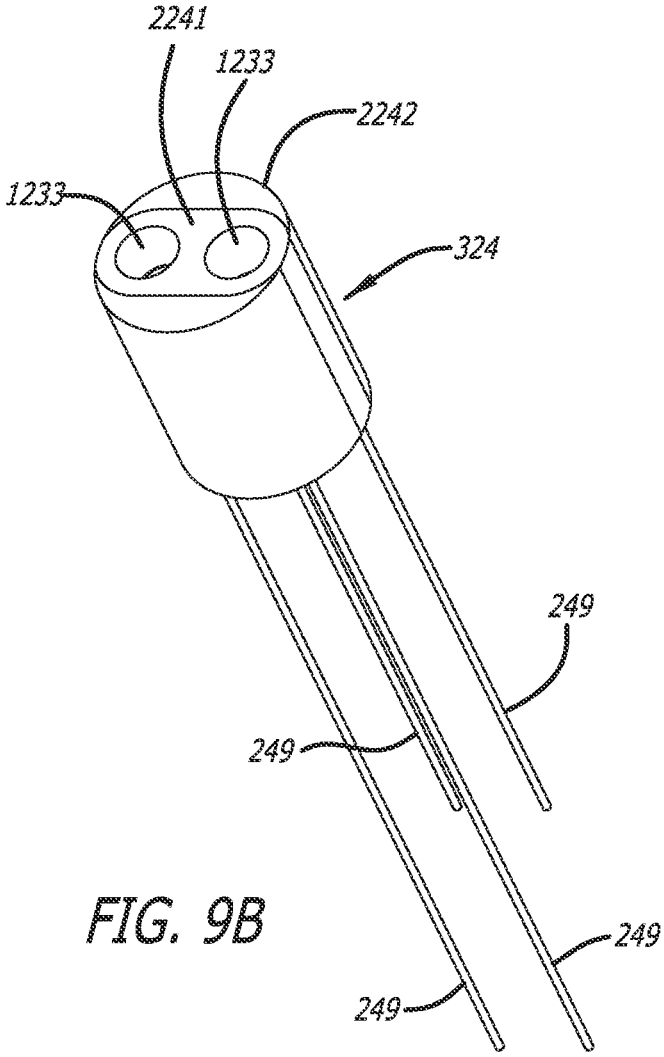
FIG. 9B illustrates a perspective view of the atomizer core of FIG. 9A.
Figure 10:
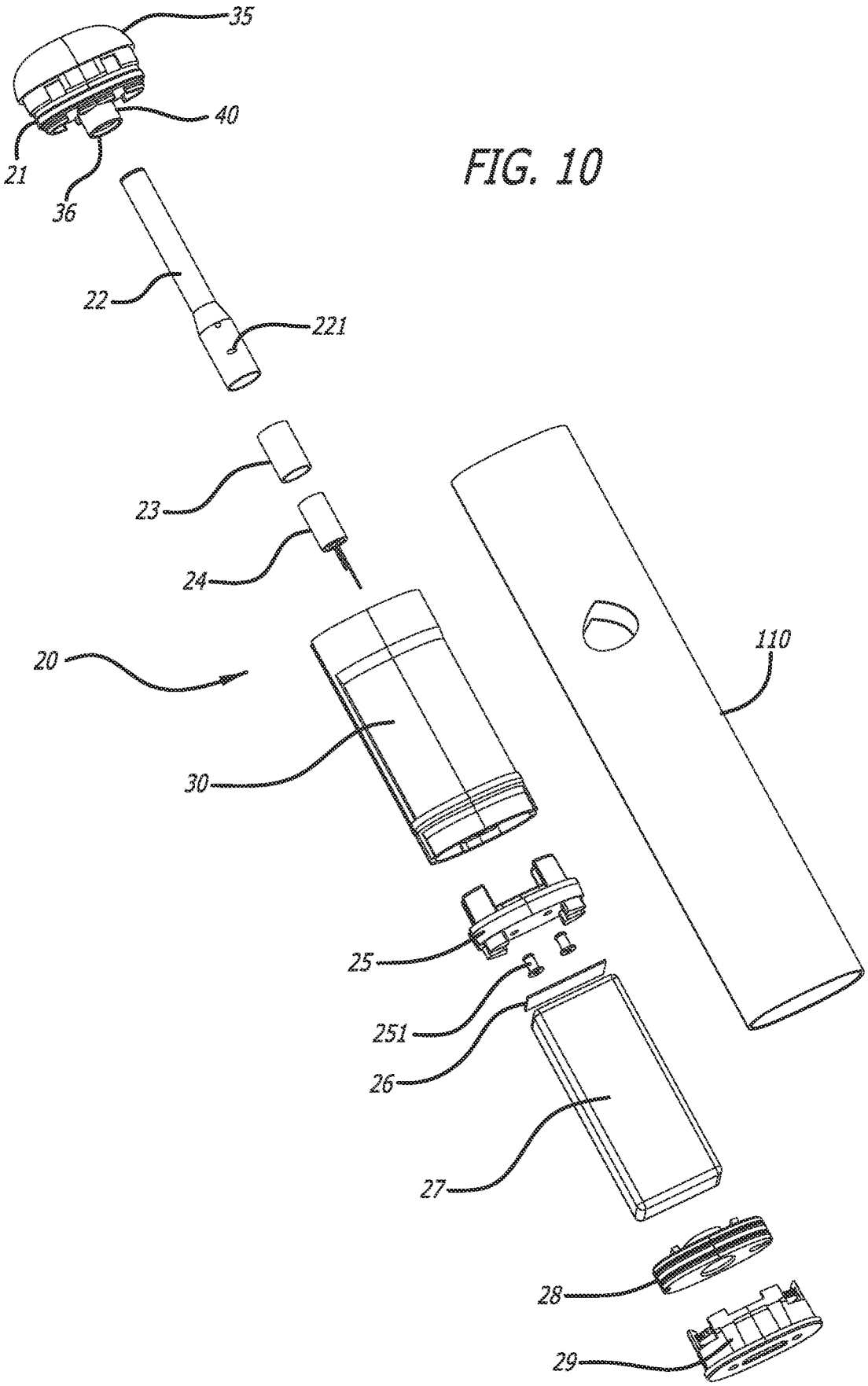
FIG. 10 illustrates an exploded view of an electronic cigarette assembly including an atomizer core according to an embodiment of the present invention.
Figure 11:
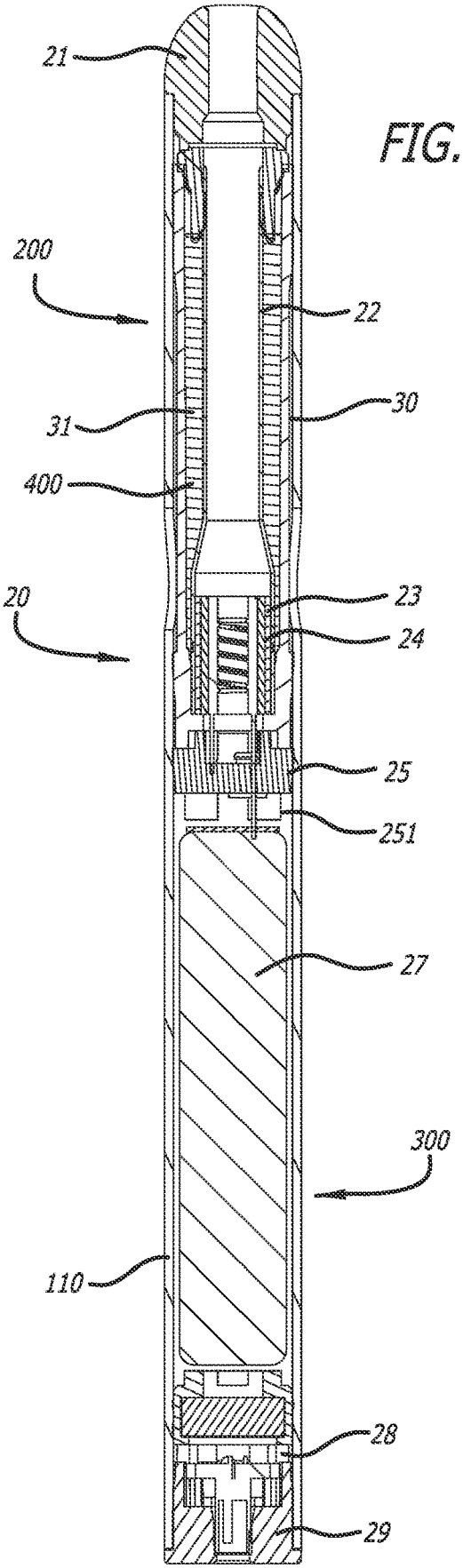
FIG. 11 illustrates a cross-sectional side elevation view of the assembled electronic cigarette assembly of FIG. 10.
Figure 12:
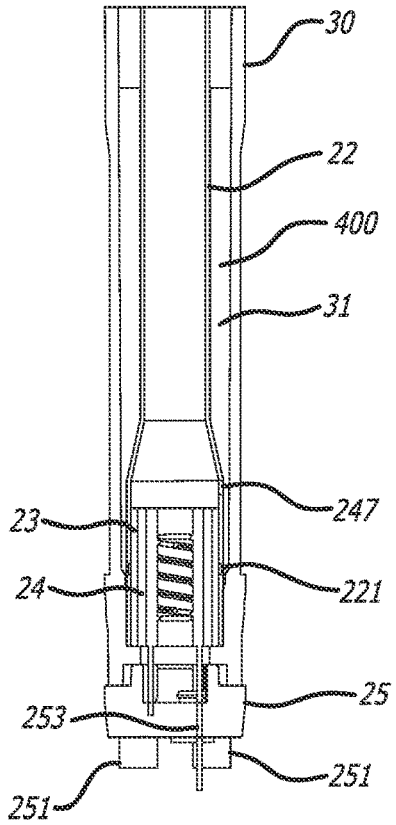
FIG. 12 illustrates a cross-sectional front elevation view of an atomizer assembly (without an upper cap) of the electronic cigarette assembly of FIG. 10.

With reference to FIGS. 1-12, embodiments of the present invention provide for an improved electronic cigarette device. As shown in FIGS. 10-12, an electronic cigarette assembly 20 includes an atomizer assembly 200 and a battery assembly 300. The atomizer assembly 200 includes a housing 30, an upper cap 21, a smoke guide tube or atomization tube 22, an e-liquid guide cotton 23, a ceramic atomizer core 24, an e-liquid storage chamber or cavity 31, an upper sealing seat 25, and a magnet 26. The magnet 26 is configured to engage the atomizer assembly 200 with the battery assembly 300. The battery assembly 300 includes a battery assembly body 27, a lower sealing seat 28, and a lower cap 29. The upper sealing seat 25 and the lower sealing seat 28 may be made from various materials including, but not limited to, silicone, plastic (e.g., thermoplastic, thermoelastic, thermosetting, etc.), and the like. The upper cap 21 and the lower cap 29 may be made from various materials including, but not limited to, plastic (e.g., thermoplastic (e.g., Poly Cyclohexylenedimethylene Terephthalate glycol-modified (PCTG), Polycarbonates (PC), and the like), thermoelastic, thermosetting, etc.), silicone, and the like. The atomizer assembly 200 and the battery assembly 300 are generally disposed within a housing sleeve 110. A portion of the upper cap 21 is received within the housing sleeve 110 at a top end of the housing sleeve 110, and a portion of the lower cap 29 is received within the housing sleeve 110 at a bottom end of the housing sleeve 110. A portion of the upper cap 21 is received within the housing 30 at a top end of the housing 30, and a portion of the upper sealing seat 25 is received within the housing 30 at a bottom end of the housing 30.

The ceramic atomization core 24 is disposed within a lower end of the atomization tube 22. While ceramic atomization core 24 is illustrated in use in FIGS. 10-12, ceramic atomization cores 124, 224, 324 are also suitable for use in the illustrated electronic cigarette assembly 20. The atomization tube 22 includes an inner, generally cylindrical atomization channel 33. While the atomization channel 33 is illustrated as being generally cylindrical, the atomization channel 33 can have other shapes including polygonal shapes where the atomization channel could have three (3) or more sides. The inner atomization channel 33 is configured to provide a path for discharge of aerosol or vapor to the upper cap 21. The aerosol or vapor is generated by heating and atomization of e-liquid 400 by the ceramic atomization core 24. The upper cap 21 includes a mouthpiece portion 35 for engagement with a user's mouth during use of the electronic cigarette assembly 20. The upper cap 21 also includes a channel or passage 36 defining a path to the atomization tube 22 through which the aerosol or vapor passes through the upper cap 21 to a user's mouth for subsequent inhalation. One end of the channel or passage 36 is open at the mouthpiece portion 35 and one end of the channel or passage 36 is open to the atomization tube 22 through a guide portion 40 of the upper cap 21. The open upper end of the atomization tube 22 extends into the guide portion 40 of the upper cap 21 in communication with the channel or passage 36 such that vaporized liquid or smoke passes from the atomization tube 22 into the channel or passage 36 for subsequent inhalation by the user as the mouthpiece portion 35 is in communication with the atomization channel 33.

The atomization tube 22 includes at least one e-liquid inlet hole 221 corresponding to the ceramic atomization core 24. The e-liquid inlet hole 221 allows e-liquid 400 in the e-liquid storage chamber or cavity 31 to enter the ceramic atomization core 24 and move towards an electric heating element 50 for atomization into aerosol or vapor. The e-liquid 400 is transferred from the e-liquid storage chamber or cavity 31 to the e-liquid guide cotton 23 through the e-liquid inlet hole 221 and finally into the ceramic core 24. As mentioned above, the "e-liquid" or "e-juice" 400 is a liquid solution that may contain varying amounts of various substances (alone or in combination) that can include, without limitation, nicotine, *cannabis* (e.g., THC, CBD), flavorings, and/or other chemicals.

As shown in FIGS. 1-6, a first embodiment of an atomization core 24 is illustrated. The ceramic atomization core 24 is generally cylindrical, and includes a generally cylindrical first layer or inner layer 241, a generally cylindrical second layer or outer layer 242, and an electric heating element 50 inlaid in the atomization core 24. The generally cylindrical first and second layers 241, 242 are generally concentric, adjacent, and aligned about a central axis (not shown). The first and second layers 241, 242 of the atomization core 24 may be made of various ceramic materials including, but not limited to, a microporous ceramic having micropores. The micropores can be in the general range of about 8 μm to about 18 μm, preferably about 13 μm. The first layer 241 includes a porosity less than that of the second layer 242 (i.e., the porosity of the layers 241, 242 decreases sequentially from the outer layer (i.e., second layer 242) to the inner layer (i.e., first layer 241). A result is that the first layer 241 has an e-liquid absorption speed less than that of the second layer 242. In general, when multiple ceramic layers are provided, the porosity decreases sequentially from outside to inside, and accordingly the speed decreases sequentially from outside to inside. The combination of the at least two layers of ceramic material having different porosities provides the atomization core 24 with the advantages of both high porosity and low porosity while avoiding the disadvantages of single-layer conventional atomization cores where the single-layer has either a high porosity or a low porosity. It should be noted that the positions of the less porosity layer and the more porosity layer can be interchanged. As long as the combination of the two layers can achieve the goal of a reasonable oil absorption speed.

As illustrated, e-liquid is transferred from the e-liquid storage cavity 31 to the e-liquid guide cotton 23 through the e-liquid inlet hole 221, then to the second ceramic layer 242, and finally to the first ceramic layer 241. The e-liquid is buffered and stored by providing a multilayer ceramic core, so that e-liquid supply is stable. A first advantage is that e-liquid absorption is performed by the outer ceramic layer (i.e., the second layer 242) having a high porosity, so that the continuity of the e-liquid supply is good, and no empty absorption event occurs, and a second advantage is that the e-liquid absorption is performed by an inner ceramic layer (i.e., the first layer 241 having a low porosity, so that e-liquid leakage caused by the speed and angle of e-liquid supply is reduced, if not avoided.

The electric heating element 50 is spirally arranged. The electric heating element 50 includes an electric heating element body 248, and pins 249 led out from two (2) ends of the electric heating element body 248. A bottom portion of the ceramic atomization core 24 is disposed on the sealing seat 25. The sealing seat 25 includes holes 253 through which the pins 249 of the ceramic core 24 extend into a channel of the battery assembly 300, with the pins 249 riveted with two poles of the battery assembly 300. A pair of electrodes 251 are made of various materials including, without limitation, conductive metal. The electrodes 251 are separate electrically connected to the pins 249.

The electric heating element 50 may come in various forms including, but not limited to two (2) identical electric heating element bodies connected in parallel together and soldered at two ends. In one illustrative embodiment, the size of a soldered dot left after soldering cannot be more than 0.35 mm (as the larger the soldered dot, the easier it becomes for a portion of the soldered dot to contact an adjacent heating coil of the electric heating element 50, and cause a short circuit).

As shown in FIGS. 1-6, a first embodiment of an atomization core 24 is illustrated. The ceramic atomization core 24 is generally cylindrical, and includes a generally cylindrical first layer or inner layer 241, a generally cylindrical second layer or outer layer 242, and an electric heating element 50 inlaid in the atomization core 24. The generally cylindrical first and second layers 241, 242 are generally concentric, adjacent, and aligned about a central axis (not shown). The first and second layers 241, 242 of the atomization core 24 may be made of various ceramic materials including, but not limited to, a microporous ceramic having micropores. The micropores can be in the general range of about 8 μm to about 18 μm, preferably about 13 μm. The first layer 241 includes a porosity less than that of the second layer 242 (i.e., the porosity of the layers 241, 242 decreases sequentially from the outer layer (i.e., second layer 242) to the inner layer (i.e., first layer 241). A result is that the first layer 241 has an e-liquid absorption speed less than that of the second layer 242. In general, when multiple ceramic layers are provided, the porosity decreases sequentially from outside to inside, and accordingly the speed decreases sequentially from outside to inside. The combination of the at least two layers of ceramic material having different porosities provides the atomization core 24 with the advantages of both high porosity and low porosity while avoiding the disadvantages of single-layer conventional atomization cores where the single-layer has either a high porosity or a low porosity. Again, it should be noted that the positions of the less porosity layer and the more porosity layer can be interchanged. As long as the combination of the two layers can achieve the goal of a reasonable oil absorption speed. The shape of the ceramic atomization core 24 may be made by various methods including, without limitation, being integrally formed by injection molding. As set forth above, the atomization core 24 has an inner, generally cylindrical atomization channel (or central channel) 33 configured to provide a path for discharge of aerosol or vapor to the atomization channel of the atomization tube 22. The ceramic atomization core 24 is of one-piece construction with the first layer 241 and the second layer 242 made from the same or different ceramic materials. In the alternative, the ceramic atomization core 24 may be made from separate first and second layers 241, 242 joined together, where the first and second layers 241, 242 may be made from the same or different microporous materials (e.g., ceramic). The exterior surfaces of the first and second layers 241, 242 may be viewed as surfaces through which e-liquid or e-liquid vapor is absorbed, while e-liquid or vaporized e-liquid is emitted from the interior surface of the first layer 241 forming the atomization channel 33. The first and second layers 241, 242 are each at least 0.7 mm. The thickness of the two layers can be the same or one layer can be thicker than the other. The thickness of a layer can be adjusted in relation to the desired porosity of that layer.

Figure 7A:
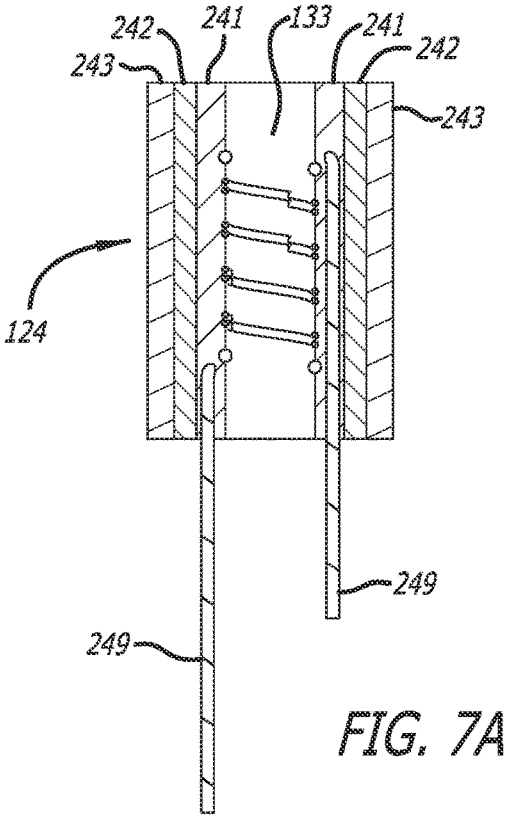
FIG. 7A illustrates a cross-sectional side elevation view of an atomizer core of an electronic cigarette assembly according to another embodiment of the present invention.
Figure 7B:
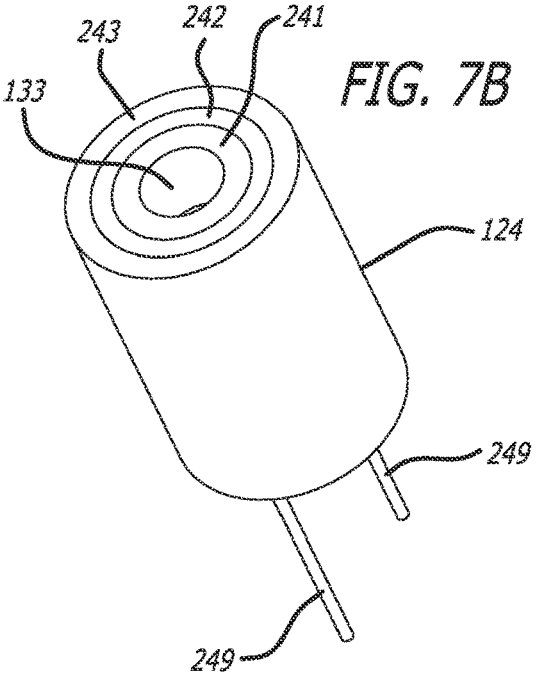
FIG. 7B illustrates a perspective view of the atomizer core of FIG. 7A.

As shown in FIGS. 7A-7B, a second embodiment of an atomization core 124 is illustrated. The ceramic atomization core 124 is the same/similar to the atomization core 24, with the main exception that the atomization core 124 includes a third layer 243, and other parts being arranged in the same/similar manner. The atomization core 124 includes a first (inner) layer 241, a second (middle) layer, and the third (outer) layer 243. The layers 241, 242, 243 of the atomization core 124 may be made of various ceramic materials including, but not limited to, a microporous ceramic having micropores. The micropores can be in the general range of about 8 μm to about 18 μm, preferably about 13 μm. The ceramic material of the first layer 241 has a porosity greater than that of the ceramic material of the second layer 242, and that of the ceramic material of the third layer 243. That is, the first layer 241 has an e-liquid absorption speed greater than that of the second layer 242, and that of the third layer 243. The ceramic atomization core 124 is of one-piece construction with the first, second, and third layers 241, 242, 243 made from the same or different ceramic materials. In the alternative, the ceramic atomization core 124 may be made from separate first, second, and third layers 241, 242, 243 joined together, where the first, second, and third layers 241, 242, 243 may be made from the same or different microporous materials (e.g., ceramic). The outer surfaces of the first, second, and third layers 241, 242, 243 may be viewed as surfaces through which e-liquid or e-liquid vapor is absorbed, while e-liquid or vaporized e-liquid is emitted from the interior surface of the first layers 241 forming the atomization channel 133. Again, the first, second, and third layers 241, 242, 243 are each at least 0.7 mm. The thickness of the first, second, and third layers can be the same or one layer can be thicker or thinner than the other layers. The thickness of a layer can be adjusted in relation to the desired porosity of that layer.

Figure 8A:
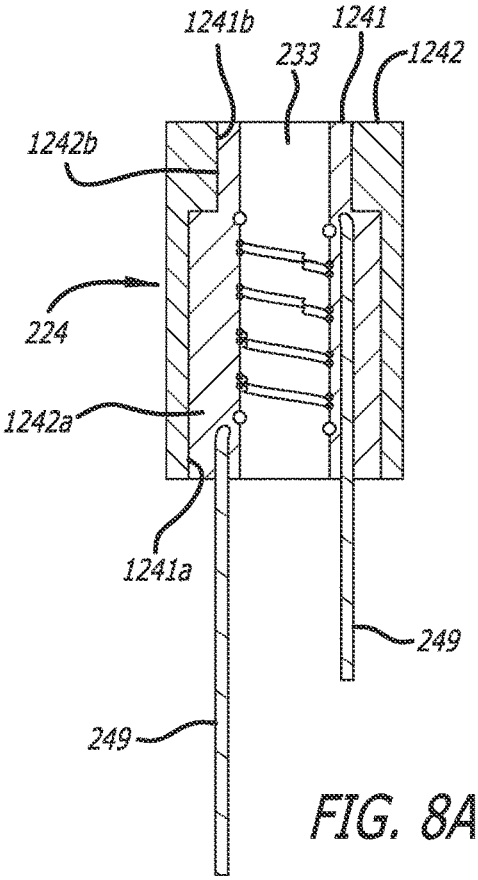
FIG. 8A illustrates a cross-sectional view of an atomizer core of an electronic cigarette assembly according to a further embodiment of the present invention.
Figure 8B:
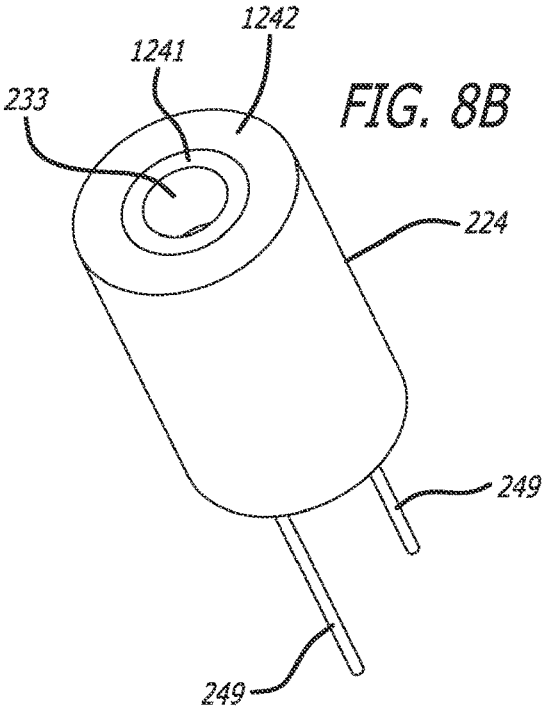
FIG. 8B illustrates a perspective view of the atomizer core of FIG. 8A.

As shown in FIGS. 8A-8B, a third embodiment of an atomization core 224 is illustrated. The ceramic atomization core 224 includes ceramic inner and outer layers 1241, 1242, and is the same/similar to the generally cylindrical atomization core 24, with the main exception that the inner layer 1241 does not have a constant outer diameter between top and bottom, and the outer layer 1242 does not have a constant inner diameter between top and bottom. The generally cylindrical first and second layers 1241, 1242 are generally concentric, adjacent, and aligned about a central axis (not shown). As shown in FIGS. 8A-8B, the outer diameter of the first layer or inner layer 1241 is sized and shaped to match the inner diameter of the second layer or outer layer 1242. The first layer or inner layer 1241 has a generally cylindrical, constant inner diameter between top and bottom, but the outer diameter of the first layer or inner layer 1241 has a generally cylindrical first portion or lower portion 1241*a* having a constant diameter, and a generally cylindrical second portion or upper portion 1241*b* having a constant diameter, where the outer diameter of the first portion 1241*a* is greater than the outer diameter of the second portion 1241*b*. The second layer or outer layer 1242 has a generally cylindrical, constant outer diameter between top and bottom, but the inner diameter of the second layer or outer layer 1242 has a generally cylindrical first portion or lower portion 1242*a* having a constant diameter, and a generally cylindrical second portion or upper portion 1242*b* having a constant diameter, where the inner diameter of the first portion 1242*a* is greater than the outer diameter of the second portion 1242*b*. The outer diameter of the first portion (or lower portion) 1241*a* of the first layer (or inner layer) 1241 is generally equal to the inner diameter of the first portion or lower portion 1242*a* of the first portion (or lower portion) 1242*a* of the second layer (or outer layer) 1242. The outer diameter of the second portion (or upper portion) 1241*b* of the first layer (or inner layer) 1241 is generally equal to the inner diameter of the second portion or upper portion 1242*b* of the second layer (or outer layer) 1242.

The first and second layers 1241, 1242 of the atomization core 224 may be made of various ceramic materials including, but not limited to, a microporous ceramic having micropores. The micropores can be in the general range of about 8 μm to about 18 μm, preferably about 13 μm. The first layer 1241 includes a porosity less than that of the second layer 1242 (i.e., the porosity of the layers 1241, 1242 decreases sequentially from the outer layer (i.e., second layer 1242) to the inner layer (i.e., first layer 1241). A result is that the first layer 1241 has an e-liquid absorption speed less than that of the second layer 1242. The combination of the at least two layers of ceramic material having different porosities provides the atomization core 224 with the advantages of both high porosity and low porosity while avoiding the disadvantages of single-layer conventional atomization cores where the single-layer has either a high porosity or a low porosity. In the alternative, the porosity of the first layer 1241 can be greater than that of the porosity of the second layer 1242.

The shape of the ceramic atomization core 224 may be made by various methods including, without limitation, being integrally formed by injection molding. In essence, the inner layer or first layer 1241 has the appearance that a recess or notch has been formed around the circumference of the upper portion 1241*b* of the atomization core 224. The ceramic core 224 has an inner, generally cylindrical atomization channel (or central channel) 233 configured to provide a path for discharge of aerosol or vapor to an atomization channel of the smoke guide tube or atomization tube 22. The diameter of the atomization channel 233 is defined by the inner diameter of the first layer (or inner layer) 1241. The ceramic atomization core 224 is of one-piece construction with the first layer (or inner layer) 1241 and the second layer (or outer layer) 1242 made from the same ceramic material. In the alternative, the ceramic atomization core 124 may be made from separate first and second layers 1241, 1242 joined together, where the first and second layers 1241, 1242 may be made from the same or different microporous materials (e.g., ceramic). The exterior surfaces of the first and second layers 1241, 1242 may be viewed as surfaces through which e-liquid or e-liquid vapor is absorbed, while e-liquid or vaporized e-liquid is emitted from the interior surfaces of the first layer 1241 forming the atomization channel 233. It should again be noted that the first and second layers 1241, 1242 are each at least 0.7 mm. The thickness of the two layers can be the same or one layer can be thicker than the other. The thickness of a layer can be adjusted in relation to the desired porosity of that layer.

As seen in FIGS. 9A-9B, a fourth embodiment of an atomization core 324 is illustrated. The ceramic atomization core 324 includes ceramic inner and outer layers 2241, 2242, and is the same/similar to the generally cylindrical atomization core 24, with the main exceptions that the atomization core 324 includes two (2) atomization channels 1233, and that portions of the inner layer 2241 form portions of an outer surface of the atomization core 324, and with other parts being arranged in the same/similar manner. There are two (2) separate electric heating elements 50, and they are parallel circuits. Each atomization channel 1233 has its own heating element 50. Each heating element 50 has a pair of leads 249. In the alternative, a single heating element 50 can be arranged around the two atomization channels 1233.

In addition, the claimed invention is not limited in size and may be constructed in various sizes in which the same or similar principles of operation as described above would apply. Furthermore, the figures (and various components shown therein) of the specification are not to be construed as drawn to scale.

The terminology used herein is for the purpose of describing particular example embodiments only and is not intended to be limiting. Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps. In other words, unless explicitly stated to the contrary, embodiments "comprising" or "having" an element or a plurality of elements having a particular property can include additional elements not having that property. In other words, the terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. In other words, the use of "including," "comprising," "having," "containing," "involving," and variations thereof, is meant to encompass the items listed thereafter and additional items. Further, references to "one embodiment" or "one implementation" are not intended to be interpreted as excluding the existence of additional embodiments or implementations that also incorporate the recited features. The term "exemplary" is intended to mean "an example of".

As used herein, the singular forms "a", "an" and "the" may be intended to include the plural forms as well, unless the context clearly indicates otherwise. In other words, an element or step recited in the singular and preceded by the word "a" or "an" should be understood as not necessarily excluding the plural of the elements or steps. Further, references to "one embodiment" or "one implementation" are not intended to be interpreted as excluding the existence of additional embodiments or implementations that also incorporate the recited features. Thus, when introducing elements of aspects of the disclosure or the examples thereof, the articles "a," "an," "the," and "said" are intended to mean that there are one or more of the elements. In other words, the indefinite articles "a", "an", "the", and "said" as used in the specification and in the claims, unless clearly indicated to the contrary, should be understood to mean "at least one." The use of the expression "at least" or "at least one" suggests the use of one or more elements or ingredients or quantities, as the use may be in the embodiment of the disclosure to achieve one or more of the desired objects or results.

The numerical values mentioned for the various physical parameters, dimensions or quantities are only approximations and it is envisaged that the values higher/lower than the numerical values assigned to the parameters, dimensions or quantities fall within the scope of the disclosure, unless there is a statement in the specification specific to the contrary. Any range or value given herein can be extended or altered without losing the effect sought, as will be apparent to the skilled person.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

In the description of the present invention, several means one or more, a plurality of means more than two, greater than, less than, more than, and the like are understood as not including this number, while above, below, within, and the like are understood as including this number. If there are the descriptions of first and second, it is only for the purpose of distinguishing technical features, and should not be understood as indicating or implying relative importance, implicitly indicating the number of the indicated technical features or implicitly indicating the order of the indicated technical features.

In the description of the present invention, it should be noted that the terms "installation", "connected" and "connection" if any shall be understood in a broad sense unless otherwise specified and defined. For example, they may be fixed connection, removable connection or integrated connection; may be mechanical connection or electrical connection; and may be direct connection, or indirect connection through an intermediate medium, and connection inside two elements. The specific meanings of the above terms in the present invention can be understood in a specific case by those of ordinary skills in the art.

While various spatial and directional terms, such as "up", "down", "front", "rear", "left", "right", "vertical", "horizontal", "top", "bottom", "inside", "outside", "upper," "lower," and the like are used to describe embodiments and implementations of the present disclosure, it is understood that such terms are merely used with respect to the orientations shown in the drawings. The orientations can be inverted, rotated, or otherwise changed, such that a top side becomes a bottom side if the structure is flipped 180 degrees, becomes a left side or a right side if the structure is pivoted 90°, and the like. In other words, spatially relative terms, such as "inner," "outer," "beneath", "below", "above", "lateral", "longitudinal" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

In the description of the present invention, it should be understood that the orientation or position relationship indicated by the terms is based on the orientation or position relationship shown in the accompanying drawings, it is only for the convenience of description of the present invention and simplification of the description, and it is not to indicate or imply that the indicated device or element must have a specific orientation, and be constructed and operated in a specific orientation. Therefore, the terms shall not be understood as limiting the present invention.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

It will be understood that the benefits and advantages described above can relate to one embodiment or can relate to several embodiments. The embodiments are not limited to those that solve any or all of the stated problems or those that have any or all of the stated benefits and advantages. It will further be understood that reference to 'an' item refers to one or more of those items.

The order of execution or performance of the operations in examples of the disclosure illustrated and described herein is not essential, unless otherwise specified. That is, the operations can be performed in any order, unless otherwise specified, and examples of the disclosure can include additional or fewer operations than those disclosed herein. For example, it is contemplated that executing or performing a particular operation before, contemporaneously with, or after another operation (e.g., different steps, etc.) is within the scope of aspects and implementations of the disclosure. In other words, the method steps, processes, and operations described herein are not to be construed as necessarily requiring their performance in the particular order discussed or illustrated, unless specifically identified as an order of performance. It is also to be understood that additional or alternative steps may be employed.

The phrase "one or more of the following: A, B, and C" means "at least one of A and/or at least one of B and/or at least one of C." The phrase "and/or", as used in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of or "exactly one of," or, when used in the claims, "consisting of," will refer to the inclusion of exactly one element of a number or list of elements. In general, the term "or" as used shall only be interpreted as indicating exclusive alternatives (i.e., "one or the other but not both") when preceded by terms of exclusivity, such as "either," "one of" "only one of" or "exactly one of." "Consisting essentially of," when used in the claims, shall have its ordinary meaning as used in the field of patent law.

As briefly discussed above, as used in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

Use of ordinal terms such as "first," "second," "third," etc., in the claims to modify a claim element does not by itself connote any priority, precedence, or order of one claim element over another or the temporal order in which acts of a method are performed. Ordinal terms are used merely as labels to distinguish one claim element having a certain name from another element having a same name (but for use of the ordinal term), to distinguish the claim elements.

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

It is to be understood that the above description is intended to be illustrative, and not restrictive. For example, the above-described embodiments (and/or aspects thereof) can be used in combination with each other. In addition, many modifications can be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are example embodiments. Many other embodiments will be apparent to those of ordinary skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112 (f), unless and until such claim limitations expressly use the phrase "means for" followed by a statement of function void of further structure.

This written description uses examples to disclose the various embodiments of the disclosure, including the best mode, and also to enable any person of ordinary skill in the art to practice the various embodiments of the disclosure, including making and using any devices or systems and performing any incorporated methods. The patentable scope of the various embodiments of the disclosure is defined by the claims, and can include other examples that occur to those persons of ordinary skill in the art. Such other examples are intended to be within the scope of the claims if the examples have structural elements that do not differ from the literal language of the claims, or if the examples include equivalent structural elements with insubstantial differences from the literal language of the claims.

The above description presents the best mode contemplated for carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above that are fully equivalent. Moreover, features described in connection with one embodiment of the invention may be used in conjunction with other embodiments, even if not explicitly stated above. Consequently, this invention is not limited to the particular embodiments disclosed. On the contrary, this invention covers all modifications and alternate constructions coming within the spirit and scope of the invention as generally expressed by the following claims, which particularly point out and distinctly claim the subject matter of the invention.

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

Various technical features of the above embodiments may be combined randomly, and in order to simplify the description, possible combinations of various technical features in the above embodiments are not all described. However, as long as the combinations of these technical features have no contradiction, the combinations of these technical features should be considered as falling into the scope recorded by the specification.

Although the embodiments of the present invention have been shown and described, those of ordinary skills in the art may understand that various changes, modifications, substitutions and variations may be made to these embodiments without departing from the principle and purpose of the present invention, and the scope of the present invention is defined by the claims and their equivalents.

The following claims are thus to be understood to include what is specifically illustrated and described above, what is conceptually equivalent, what can be obviously substituted and also what incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

What is claimed is:

1. An atomization core, comprising:

a core body having a central channel, a generally cylindrical, ceramic first layer having an outer diameter and an inner diameter, and a generally cylindrical, ceramic second layer having an outer diameter and an inner diameter;

wherein the central channel extends through the first and second layers;

wherein the first layer, the second layer, and the central channel are aligned about a central axis;

wherein the inner diameter of the second layer is about equal to the outer diameter of the first layer; and wherein the ceramic first layer comprises a first porosity, the ceramic second layer comprises a second porosity, and the first porosity is greater than the second porosity.

2. The atomization core of claim 1, further comprising a heating element embedded in the core body and spirally arranged about the central channel.

3. The atomization core of claim 1, wherein the core body comprises a microporous ceramic.

4. The atomization core of claim 1, wherein the core body comprises a generally cylindrical core body.

5. The atomization core of claim 1, wherein the central channel comprises two separate channels.

6. The atomization core of claim 1, further comprising a third layer having an outer diameter and an inner diameter; wherein the first layer, the second layer, the third layer, and the central channel are aligned about the central axis; and wherein the inner diameter of the third layer is about equal to the outer diameter of the second layer.

7. An atomization core, comprising:

a core body having a central channel, a ceramic first layer having an outer diameter and an inner diameter, and a ceramic second layer having an outer diameter and an inner diameter;

wherein the central channel extends through the first and second layers;

wherein the first layer, the second layer, and the central channel are aligned about a central axis;

wherein the inner diameter of the second layer is about equal to the outer diameter of the first layer; and wherein the ceramic first layer comprises a first porosity, the ceramic second layer comprises a second porosity, and the first porosity is greater than the second porosity.

8. The atomization core of claim 7, further comprising a heating element embedded in the core body and spirally arranged about the central channel.

9. The atomization core of claim 7, wherein the core body comprises a microporous ceramic.

10. The atomization core of claim 7, wherein the core body comprises a generally cylindrical core body.

11. The atomization core of claim 7, wherein the central channel comprises two separate channels.

12. The atomization core of claim 7, further comprising a third layer having an outer diameter and an inner diameter; wherein the first layer, the second layer, the third layer, and the central channel are aligned about the central axis; wherein the porosity of at least one of the ceramic layers is greater than the porosity of at least one of the other ceramic layers; and wherein the inner diameter of the third layer is about equal to the outer diameter of the second layer.

13. An atomization core, comprising:

a core body, including:

a central channel;

a generally cylindrical, ceramic first layer comprising a first radially outward facing surface and a first radially inward facing surface, the first radially outward facing surface being a stepped surface; and a generally cylindrical, ceramic second layer comprising a second radially inward facing surface arranged to engage the first radially outward facing surface and a second radially outward facing surface;

wherein:

the central channel extends through the first and second layers; and the first layer, the second layer, and the central channel are aligned about a central axis.

14. The atomization core of claim 13, wherein an inner diameter of the second layer is about equal to an outer diameter of the first layer.

15. The atomization core of claim 13, wherein the ceramic first layer comprises a first porosity, the ceramic second layer comprises a second porosity, and the first porosity is greater than the second porosity.

16. The atomization core of claim 13, wherein the second radially inward facing surface is a stepped surface.

17. The atomization core of claim 13, wherein the first radially outward facing surface comprises a lower portion including a first diameter and an upper portion comprising a second diameter, and the second diameter is less than the first diameter.

18. The atomization core of claim 13, wherein the second radially inward facing surface comprises a lower portion including a first diameter and an upper portion comprising a second diameter, and the second diameter is less than the first diameter.

19. The atomization core of claim 13, further comprising a heating element embedded in the core body and spirally arranged about the central channel.

20. The atomization core of claim 13, wherein the ceramic first layer comprises a first porosity, the ceramic second layer comprises a second porosity, and the first porosity is less than the second porosity.

* * * * *